US012270174B2

(12) United States Patent
Adkins et al.

(10) Patent No.: US 12,270,174 B2
(45) Date of Patent: Apr. 8, 2025

(54) BRACE ASSEMBLY FOR A GEOSYNTHETIC WRAPPED SYSTEM USED TO CONSTRUCT STABILIZED EARTH WALLS AND SLOPES

(71) Applicant: Propex Operating Company, LLC, Chattanooga, TN (US)

(72) Inventors: Chastity Adkins, Chattanooga, TN (US); Scott Manning, Chattanooga, TN (US); Drew Loizeaux, Chattanooga, TN (US)

(73) Assignee: Propex Operating Company, LLC, Chattanooga, TN (US)

( * ) Notice: Subject to any disclaimer, the term of this patent is extended or adjusted under 35 U.S.C. 154(b) by 0 days.

(21) Appl. No.: 18/468,323

(22) Filed: Sep. 15, 2023

(65) Prior Publication Data

US 2024/0003111 A1 Jan. 4, 2024

Related U.S. Application Data

(63) Continuation of application No. 17/661,434, filed on Apr. 29, 2022, now Pat. No. 11,840,816.

(51) Int. Cl.
*E02D 17/20* (2006.01)
*E02D 29/02* (2006.01)

(52) U.S. Cl.
CPC .... *E02D 17/202* (2013.01); *E02D 2300/0015* (2013.01); *E02D 2300/0087* (2013.01); *E02D 2600/20* (2013.01); *E02D 2600/40* (2013.01)

(58) Field of Classification Search
CPC ..... E02D 17/202; E02D 29/0225; E02D 29/0241; E02D 2300/0015; E02D 2300/0087; E02D 2600/20; E02D 2600/40
See application file for complete search history.

(56) References Cited

U.S. PATENT DOCUMENTS

| | | | |
|---|---|---|---|
| 9,493,923 | B1 | 11/2016 | Miller |
| 2004/0062613 | A1 | 4/2004 | Banting |
| 2006/0204343 | A1 | 9/2006 | Kallen |
| 2011/0027016 | A1 | 2/2011 | Blouin |

(Continued)

FOREIGN PATENT DOCUMENTS

| | | | |
|---|---|---|---|
| KR | 2014094376 | A | 7/2014 |

OTHER PUBLICATIONS

Pyrawall Engineered Vegetated Wall System Product Data Sheet, 2 pages (Continued)

*Primary Examiner* — Amber R Anderson
*Assistant Examiner* — Stacy N Lawson
(74) *Attorney, Agent, or Firm* — Barnes & Thornburg LLP; Tina M. Dorr

(57) ABSTRACT

A bracing assembly for a geosynthetic wrapped system is provided. The bracing assembly includes a standing brace bar, a bottom brace bar, and a cross brace bar having different configurations to facilitate both easy and mistake free assembly of the bracing assembly. Furthermore, the standing brace bar and the bottom brace bar include guide tips that are sized and shaped to direct insertion of the standing brace bar and the bottom brace bar respectively into a weave of a geotextile fabric material such that a first connector of the bottom brace bar and a first connection slot of the standing brace bar are aligned together and with a fold line of the geotextile fabric material.

16 Claims, 11 Drawing Sheets

(56) References Cited

U.S. PATENT DOCUMENTS

| | | | |
|---|---|---|---|
| 2012/0224927 | A1 | 9/2012 | Taylor |
| 2015/0132070 | A1 | 5/2015 | Taylor |
| 2021/0292990 | A1 | 9/2021 | Manning et al. |

OTHER PUBLICATIONS

International Search Report re application No. PCT/US2022/74319, dated Oct. 28, 2022, 2 pages.
Written Opinion re application No. PCT/US2022/74319, dated Oct. 28, 2022, 7 pages.

BRACE ASSEMBLY FOR A GEOSYNTHETIC WRAPPED SYSTEM USED TO CONSTRUCT STABILIZED EARTH WALLS AND SLOPES

CROSS-REFERENCE TO RELATED APPLICATIONS

This application is a continuation of U.S. patent application Ser. No. 17/661,434, filed Apr. 29, 2022 which is incorporated by reference in its entirety.

BACKGROUND

Internally braced geosynthetic fabric layers have been used in the construction of stabilized earth walls and slopes such as shown in FIG. 1. However, the internal bracing assemblies in these systems as shown in FIGS. 2 and 3 are constructed from identical stabilizing bars. The identical nature of the stabilizing bars can result in an incorrect assembly where the upper brace that supports the upper section of the geosynthetic fabric layer is inserted into the lower brace rather than the reverse (see e.g., FIGS. 2 and 3). This incorrect assembly can lead to the braces breaking or disconnecting when in use. For example, when a down force from soil and/or rock is applied to the incorrectly assembled bracing assemble, a position of a T connector can be moved by the force causing the T connector to break or disconnect from a corresponding slot. This disconnection can cause stresses that result in the wall or slope to shift (e.g. the brace and soil or stone contained in the system are pushed outward). When such shifting occurs a potential for ripple/zipper effect is possible which can cause the wall to slide or collapse in catastrophic failure of the stabilized earth walls and slopes. Furthermore, such existing brace assemblies are known to be cumbersome to construct on a job site due to the complexity of the assembly and job site space constraints.

In light of these drawbacks, there is a need for improved assemblies. In particular, there is need for an improved bracing assembly that can be easily constructed away from a job site and that is not susceptible to an incorrect assembly. Furthermore, there is a need for systems and methods related to such an improved bracing assembly.

SUMMARY

Embodiments described herein are directed to a bracing assembly for a geosynthetic wrapped system. The bracing assembly comprises a standing brace bar having a first configuration that comprises a first guide tip, a first slot connection, and a second slot connection. The bracing assembly also comprises a bottom brace bar having a second configuration different from the first configuration. The second configuration comprises a second guide tip, a third slot connection, and a first connector configured to interface with the first slot connection to couple the bottom brace bar to the standing brace bar. Furthermore, the bracing assembly comprises a cross brace bar having a third configuration different from the first and second configurations. The third configuration comprises a second connector configured to interface with the second slot connection to couple the cross brace bar to the standing brace bar and a third connector configured to interface with the third slot connection to couple the cross brace bar to the bottom brace bar. The first guide tip and the second guide tip are sized and shaped to direct insertion of the standing brace bar and the bottom brace bar respectively into a weave of a geotextile fabric material such that the first connector and the first connection slot are aligned together and with a fold line of the geotextile fabric material.

In some embodiments of the bracing assembly, the standing brace bar comprises a first slot region in which the first slot connection is formed, a second slot region in which the second slot connection is formed, and a body disposed between the first slot region and the second slot region. The first slot region is disposed between the first guide tip and the body. In some of these embodiments, the first slot region, the second slot region, the body, and the first guide tip are formed as a single monolithic structure. Additionally or alternatively, in some of these embodiments, a respective maximum height of the first slot region and the second slot region is less than a respective maximum height of the body.

In some embodiments of the bracing assembly, the bottom brace bar comprises a slot region in which the third slot connection is formed and a body disposed between the slot region and the first connecter. The slot region is disposed between the second guide tip and the body. In some of these embodiments, the slot region, the body, and the second guide tip are formed as a single monolithic structure. Additionally or alternatively, in some of these embodiments, a respective maximum height of the slot region is less than a respective maximum height of the body.

In some embodiments of the bracing assembly, the first connector comprises a first T-connector, the second connector comprises a second T-connector, and the third connector comprise a third T-connecter. Additionally, the first slot connection comprises a T-slot connection configured to receive the first T-connector through an upper portion of the T-slot and secure the first T-connector with a lower portion of the T-slot so as to couple the bottom brace bar to the standing brace bar. The second slot connection and the third slot connection comprise respective I-connectors configured to receive the second and third T-connectors. The second and third T-connectors are rotated so as to couple the cross brace bar to the bottom brace bar.

In some embodiments of the bracing assembly, the first guide tip and the second guide tip comprise respective bullnose shapes.

In some embodiments of the bracing assembly, the bottom brace bar, the standing brace bar, and the cross brace bar are made of non-metallic, rigid or semi-rigid material. In some of these embodiments, the non-metallic, rigid or semi-rigid material includes one of nylon and high-density polypropylene (HDPE).

Embodiments, described herein are also directed to an internally braced geosynthetic fabric layer that comprises a three-dimensional woven geotextile fabric having a horizontal layer section and an external layer face. The external layer face is formed by an upright fold of the geotextile fabric. The internally braced geosynthetic fabric layer also comprises a bracing assembly that supports the external layer face in an upright position. The bracing assembly comprises a standing brace bar inserted into a weave of the upright fold of the geotextile fabric and having a first configuration. The bracing assembly also comprises a bottom brace bar inserted into a weave of the horizontal layer section of the geotextile fabric, coupled to the standing brace bar proximate to a fold line of the geotextile fabric, and having a second configuration different from the first configuration. Furthermore, the bracing assembly comprises a cross brace bar coupled to the standing brace bar and the bottom brace bar and having a third configuration different from the first and second configurations. The horizontal layer section is configured to receive soil backfill to form a horizontal reinforcement layer portion of a reinforced earth zone and slope facing system and the external layer face is configured to provide a region of the reinforced earth zone and slope facing system against which soil backfill is filled and compacted.

In some embodiments of the internally braced geosynthetic fabric layer, the first configuration comprises a first guide tip, a first slot connection, and a second slot connection. The second configuration comprises a second guide tip, a third slot connection, and a first connector that interfaces with the first slot connection to couple the bottom brace bar to the standing brace bar. The third configuration comprises a second connector that interfaces with the second slot connection to couple the cross brace bar to the standing brace bar and a third connector that interfaces with the third slot connection to couple the cross brace bar to the bottom brace bar. The first guide tip and the second guide tip are sized and shaped to direct insertion of the standing brace bar and the bottom brace bar respectively into the weave of the geotextile fabric such that the first connector and the first connection slot are aligned together and with the fold line of the geotextile fabric. In some of these embodiments, the first connector comprises a first T-connector, the second connector comprises a second T-connector, and the third connector comprise a third T-connecter. The first slot connection comprises a T-slot connection configured to receive the first T-connector through an upper portion of the T-slot and secure the first T-connector with a lower portion of the T-slot so as to couple the bottom brace bar to the standing brace bar. The second slot connection and the third slot connection comprise respective I-connectors configured to receive the second and third T-connectors, wherein the second and third T-connectors are rotated so as to couple the cross brace bar to the bottom brace bar.

In some embodiments of the internally braced geosynthetic fabric layer, the first guide tip and the second guide tip comprise respective bullnose shapes.

In some embodiments of the internally braced geosynthetic fabric layer, the bottom brace bar, the standing brace bar, and the cross brace bar are made of non-metallic, rigid or semi-rigid material.

Embodiments described herein are also directed to a method for constructing an internally braced geosynthetic fabric layer. The method comprises weaving a three-dimensional woven geotextile fabric material on a loom. Then, while the geotextile fabric material is in the loom, the method comprises inserting a bottom brace bar into a weave of a horizontal layer section of the geotextile fabric material and a standing brace bar into a weave of an upright fold of the geotextile fabric material. The method further comprises folding the geotextile fabric material so that the upright fold and the standing brace bar are in an angled orientation relative to the horizontal layer section and coupling the bottom brace bar to the standing brace bar while the upright fold and the standing brace bar are in the angled orientation. Further still, the method comprises coupling a cross brace bar to the bottom brace bar and to the standing brace bar. The standing brace bar has a first configuration, the bottom brace bar has a second configuration different from the first configuration, and the cross brace bar has a third configuration different from both the first configuration and the second configuration.

In some embodiments, the method further comprises coupling the bottom brace bar to the standing brace bar by interfacing a first connector of the bottom brace bar with a first slot connection formed in the standing brace bar and coupling the cross brace bar to the standing brace bar by interfacing a second connector of the cross brace bar with a second slot connection formed in the standing brace bar. The method also comprises coupling the cross brace bar to the bottom brace bar by interfacing a third connector of the cross brace bar with a third slot connection formed in the bottom brace bar. The first configuration comprises the first slot connection and the second slot connection, the second configuration comprises the third slot connection and the first connector, and the third configuration comprises the second connector and the third connector.

In some embodiments, the method further comprises coupling the bottom brace bar to the standing brace bar by inserting a first T-connector of the bottom brace bar into an upper portion of a T-slot connection formed in the standing brace bar and sliding the first T-connector down into a lower portion of the T-slot connection to prevent a first head of the first T-connector from passing through the upper portion of the T-slot connection. Additionally, the method comprises coupling the cross brace bar to the standing brace bar by inserting a second T-connector of the cross brace bar through a first I-slot connection formed in the standing brace bar and rotating the second T-connector to prevent a second head of the second T-connector from passing through the first I-slot connection. Furthermore, the method comprises coupling the cross brace bar to the bottom brace bar by inserting a third T-connector of the cross brace bar through a second I-slot connection formed in the bottom brace bar and rotating the third T-connector to prevent a third head of the third T-connector from passing through the second I-slot connection. In these embodiments, the first configuration comprises the T-slot connection and the first I-slot connection, the second configuration comprises the second I-slot connection and the first T-connector, and the third configuration comprises the second T-connector and the third T-connector.

In some embodiments, the method further comprises inserting a standing brace bar into a weave of an upright fold of the geotextile fabric material by first inserting a first guide tip of bottom standing bar into the weave of the upright fold. The methods also comprises inserting the bottom brace bar into the weave of the horizontal layer section of the geotextile fabric material by first inserting a second guide tip of bottom brace bar into the weave of the horizontal layer section.

DETAILED DESCRIPTION

Figure 1:
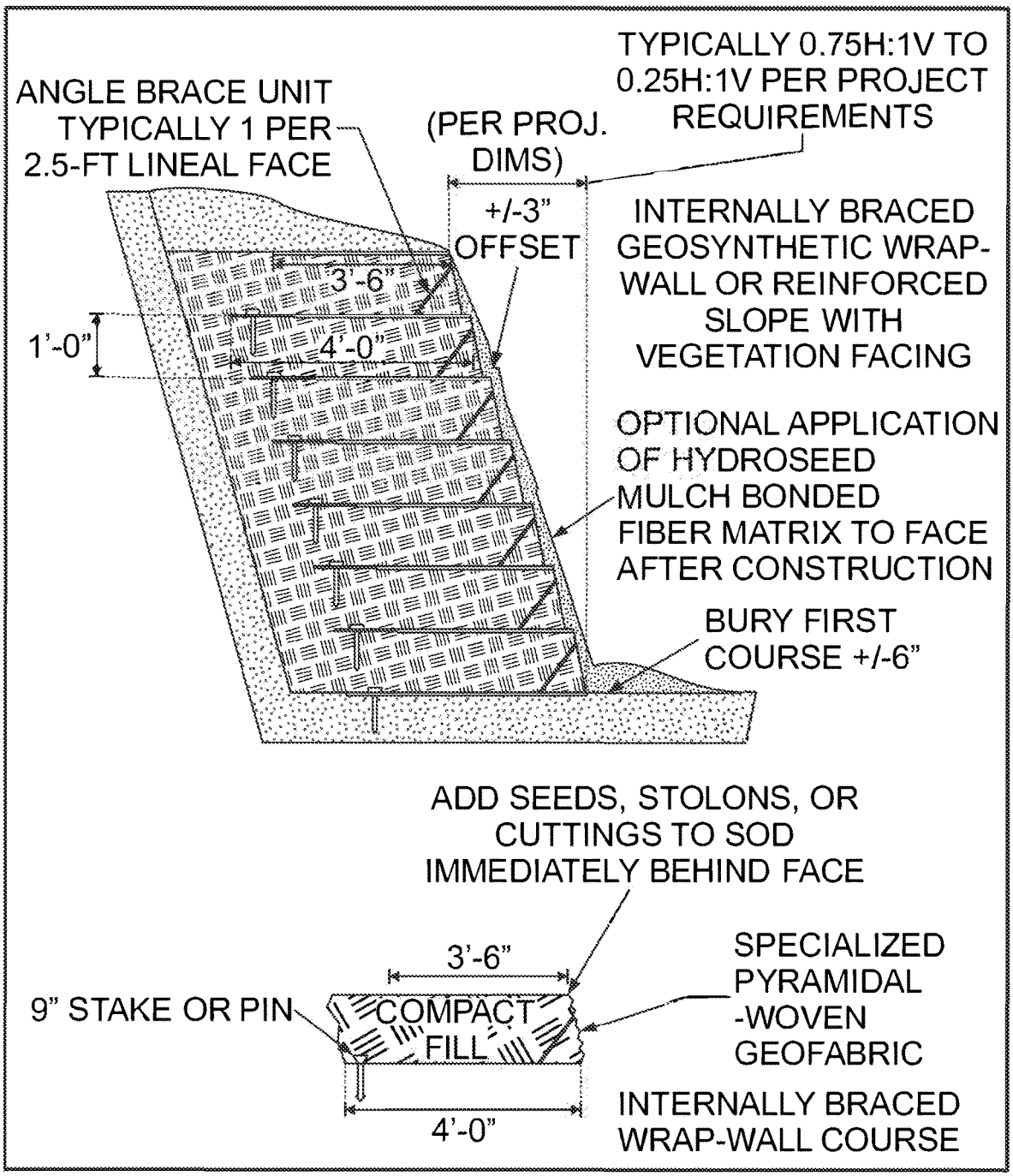
FIG. 1 (PRIOR ART)
FIG. 1 is a cross-section showing a typical constructed geosynthetic reinforced earth structure using internally braced woven geotextile fabric layers.
Figure 2:
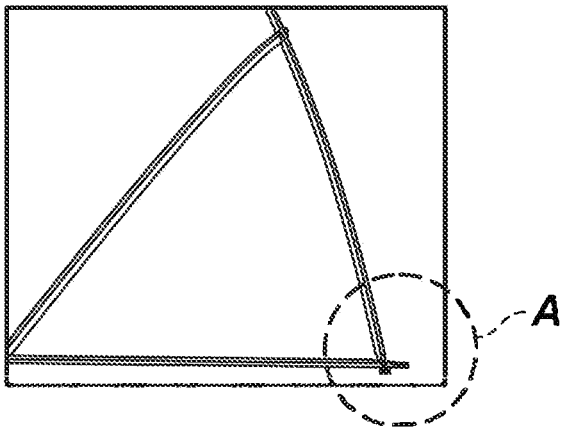
FIG. 2 (PRIOR ART)
FIG. 2 is a side view of a conventional bracing assembly.
Figure 3:
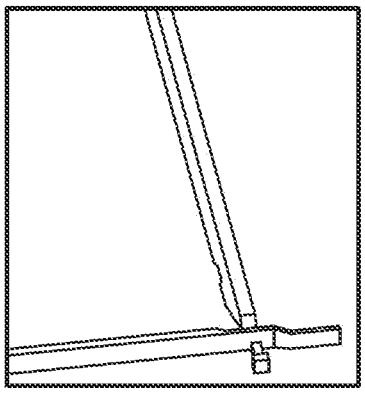
FIG. 3 (PRIOR ART)
FIG. 3 is a close up of section A of the conventional bracing assembly of FIG. 2.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 4:
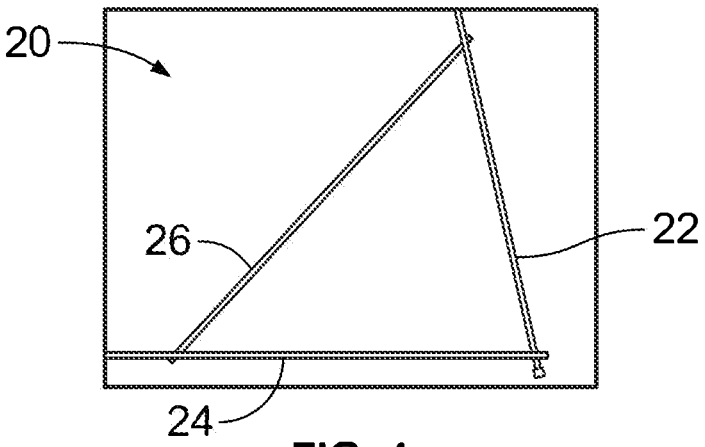
FIG. 4 is a side view of a bracing assembly according to disclosed embodiments.

FIG. 4 is side view of a bracing assembly 20 according to disclosed embodiments. As seen in FIG. 4, the bracing assembly 20 can include a standing brace bar 22 having a first configuration, a bottom brace bar 24 having a second configuration, and a cross brace bar 26 having a third configuration. As described in more detail below, the first configuration, the second configuration, and the third configuration can all be different from one another to facilitate both easy and mistake free assembly of the bracing assembly 20.

Figure 5:
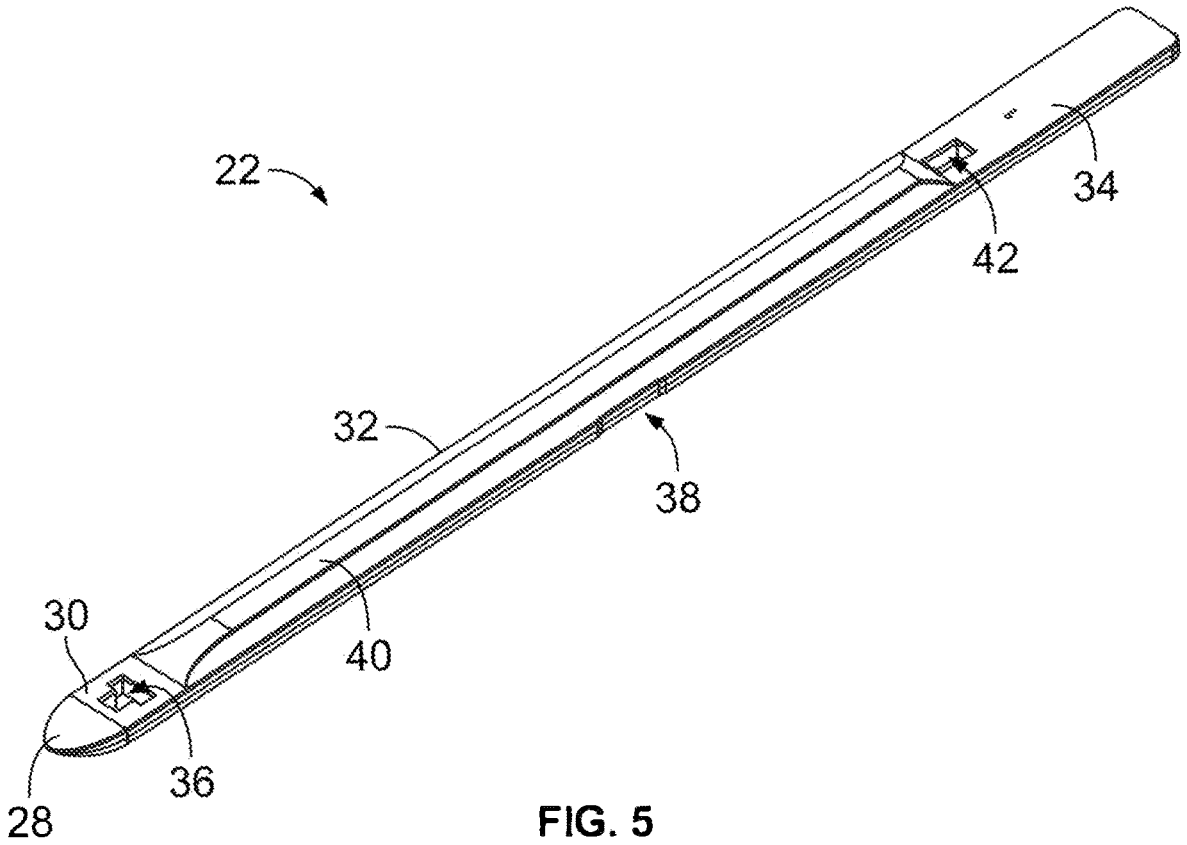
FIG. 5 is an isometric view of a standing brace bar of the bracing assembly of FIG. 4 according to disclosed embodiments.
Figure 6:
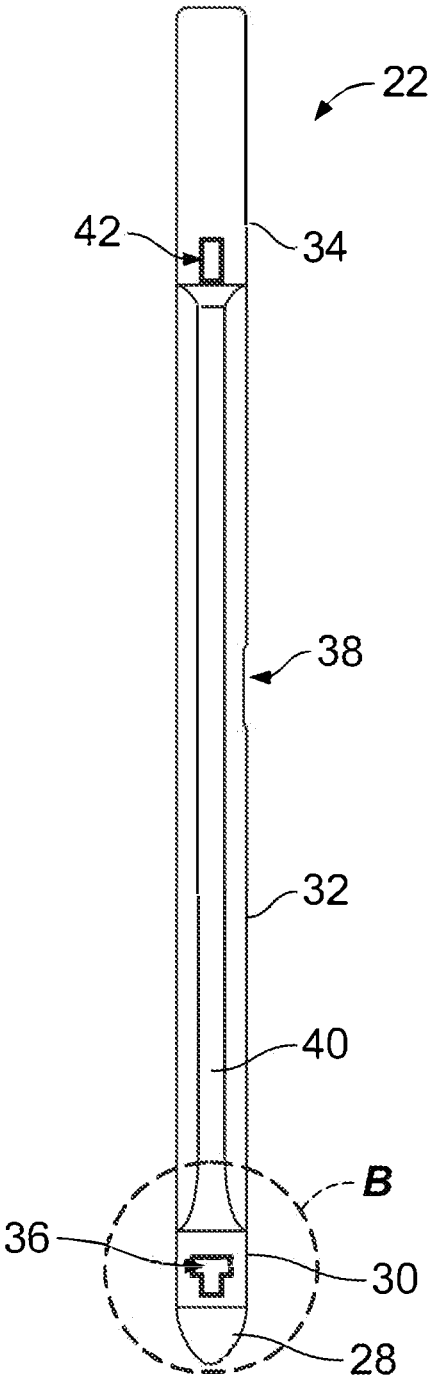
FIG. 6 is a front view of a standing brace bar of the bracing assembly of FIG. 4 according to disclosed embodiments.
Figure 7:
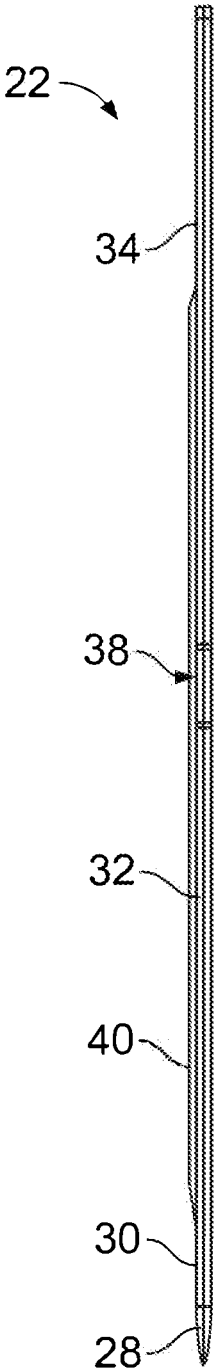
FIG. 7 is a side view of a standing brace bar of the bracing assembly of FIG. 4 according to disclosed embodiments.

FIG. 5 is an isometric view of the standing brace bar 22 according to disclosed embodiments. Furthermore, FIG. 6 is a front view of the standing brace bar 22, and FIG. 7 is a side view of the standing brace bar 22 according to disclosed embodiments. As seen in FIGS. 5-7, the standing brace bar 22 can include a first guide tip 28, a first slot region 30, a body 32, and a second slot region 34. The first slot region 30 can be disposed between the body 32 and the first guide tip 28 and can have formed therein a first slot connection 36. In some embodiments, the first slot connection 36 can include a T-slot connection as described in detail herein. The body 32 can be disposed between the first slot region 30 and the second slot region 34 and can include a raised support section 40 with a maximum height that is greater than a maximum height of the first and second slot regions 30 and 34 (see e.g. FIG. 7). In some embodiments, the raised support section 40 can be omitted, and the body 32 can have a profile matching that of the first and second slot regions 30 and 34. In some embodiments, the body 32 can include a support cutout 38 that is configured to allow the support brace bar 22 to bend and flex without breaking when used in a geosynthetic fabric layer to construct a stabilized earth wall and/or slope. Furthermore, as seen in FIGS. 5-7, the second slot region 34 can have formed therein a second slot connection 42. In some embodiments, the second slot 42 can include an I-slot.

Figure 8:
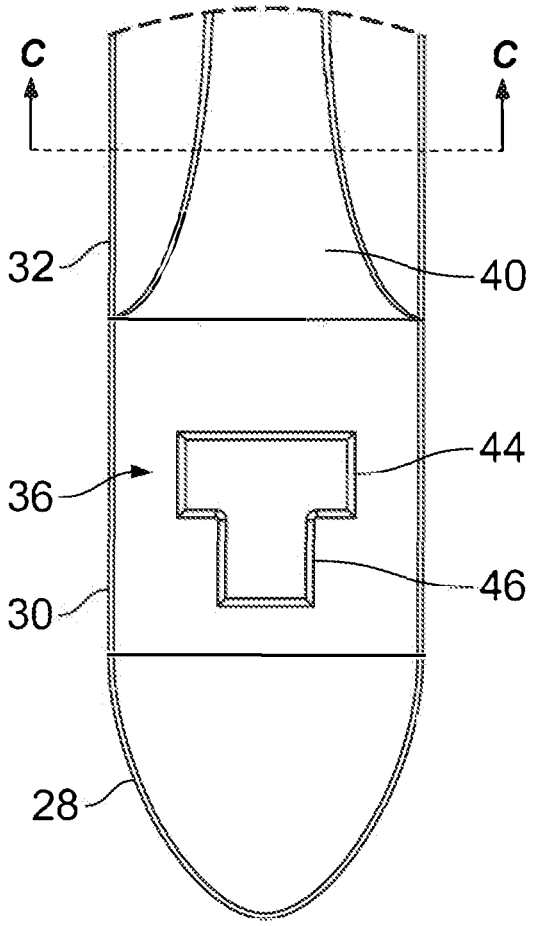
FIG. 8 is a front view of a section B of the standing brace bar of FIG. 6 according to disclosed embodiments.

FIG. 8 is a front view of a section B of the standing brace bar 22 of FIG. 6 according to disclosed embodiments. As seen in FIG. 8, the first slot connection 36 can include the T-slot connection having an upper portion 44 and a lower portion 46. Furthermore, as seen in FIG. 8, the first guide tip 28 can have a bullnose or arrow shape that assists in installation of the standing brace bar 22 into a geosynthetic fabric as described herein.

Figure 9:
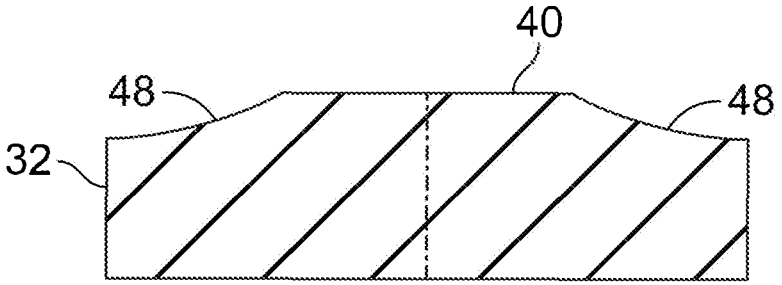
FIG. 9 is a cross-section of the standing brace bar of FIG. 6 along the line C-C according to disclosed embodiments.

FIG. 9 is a cross-section of the standing brace bar 22 along the line C-C shown in FIG. 8 according to disclosed embodiments. As seen in FIG. 9, the body 32 can include transition areas 48 that transition the height of the body 32 from the max height of the raised support section 40 to the max height of the remainder of the standing brace bar 22. In some embodiments, the transition areas 48 can be curved or sloped in a concave manner to provide support strength to the standing brace bar 22 so that the standing brace bar 22 will not break under load when used in a geosynthetic fabric layer to construct a stabilized earth wall and/or slope.

Figure 10:
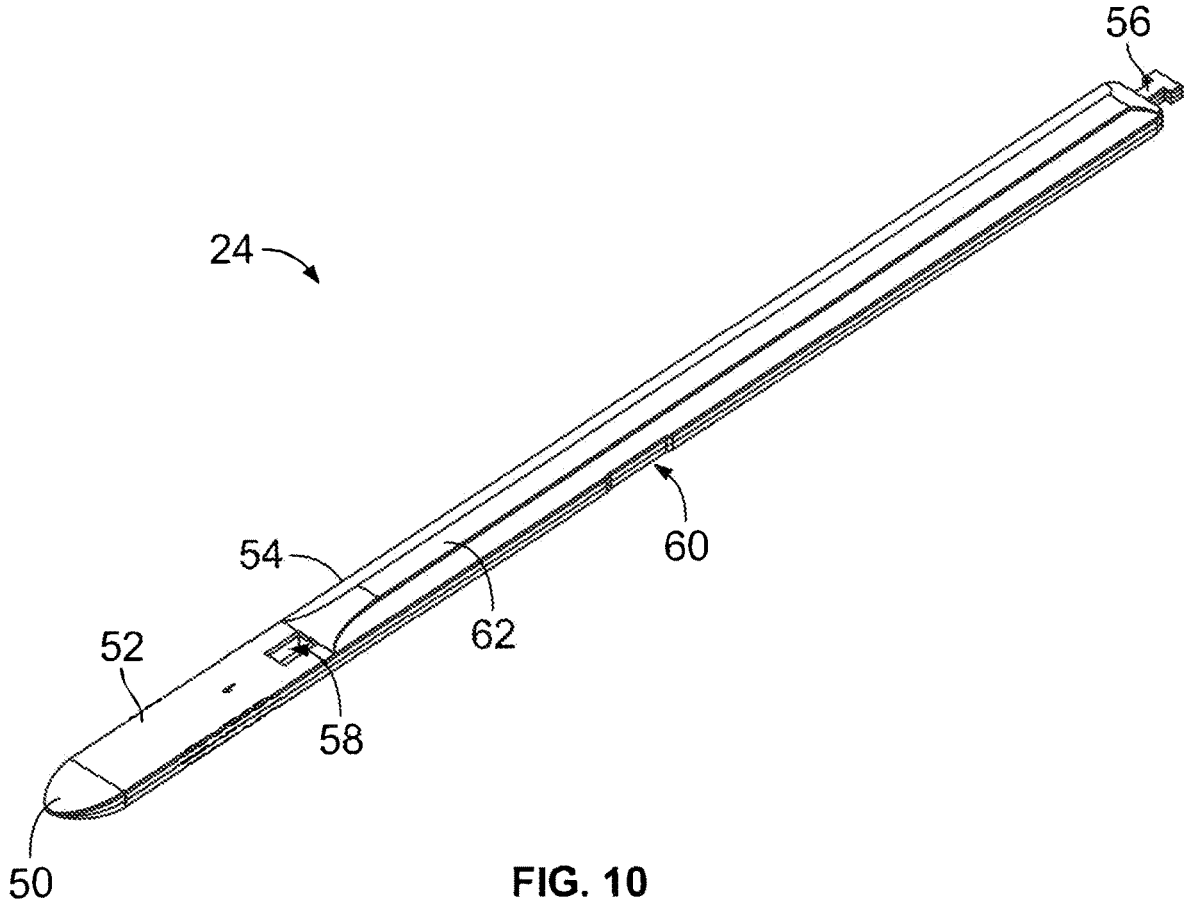
FIG. 10 is an isometric view of a bottom brace bar of the bracing assembly of FIG. 4 according to disclosed embodiments.
Figure 11:
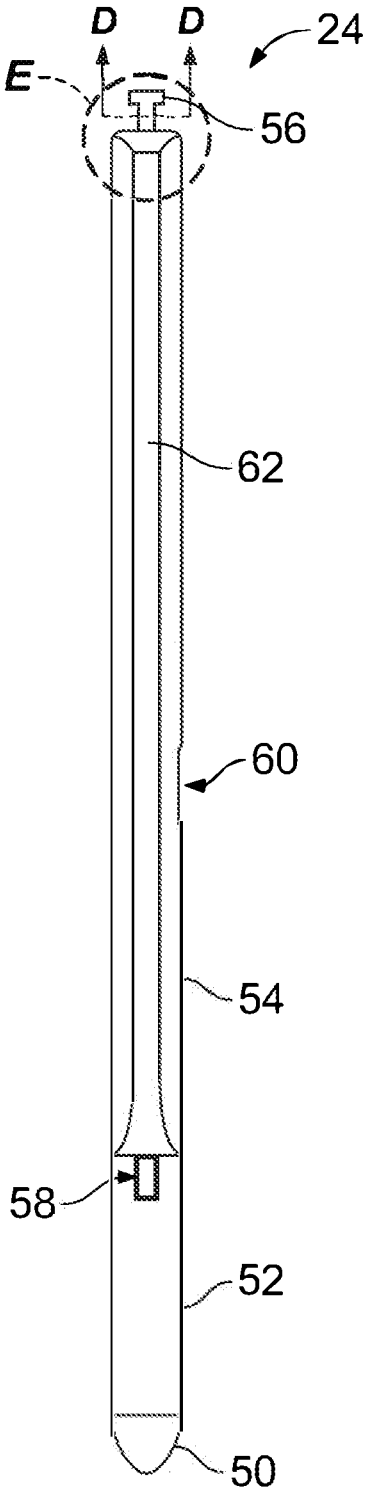
FIG. 11 is a front view of a bottom brace bar of the bracing assembly of FIG. 4 according to disclosed embodiments.
Figure 12:
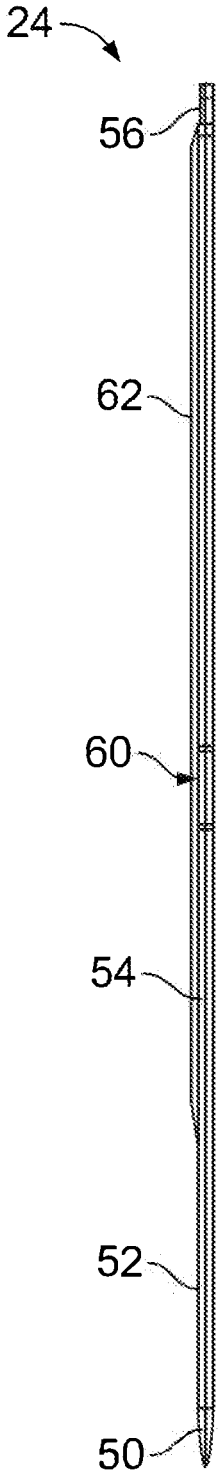
FIG. 12 is a side view of a bottom brace bar of the bracing assembly of FIG. 4 according to disclosed embodiments.

FIG. 10 is an isometric view of the bottom brace bar 24 according to disclosed embodiments. Furthermore, FIG. 11 is a front view of the bottom brace bar 24 and FIG. 12 is a side view of the bottom brace bar 22 according to disclosed embodiments. As seen in FIGS. 10-12, the bottom brace bar 24 can include a second guide tip 50 similar to the first guide tip 28, a third slot region 52 that is similar to the second slot region 34, a body 54 similar to the body 32, and a first connector 56. Like the first guide tip 28, the second guide tip 50 can have a bullnose or arrow shape that assists in installation of the bottom brace bar 24 into a geosynthetic fabric as described herein. The third slot region 52 can be disposed between the body 54 and the second guide tip 50 and can have formed therein a third slot connection 58. In some embodiments, the third slot connection 58 can include an I-slot connection as described in detail herein. The body 54 can be disposed between the third slot region 52 and the first connector 56 and can include a raised support section 60 similar to the raised support section 40 with a maximum height that is greater than a maximum height of the third slot regions 52 and the first connector 56 (see e.g., FIG. 12). In some embodiments, the raised support section 62 can be omitted, and the body 54 can have a profile matching that of the third slot regions 52 and the first connector 56. In some embodiments, the body 54 can include a support cutout 60 similar to the support cutout 38 that is configured to allow the bottom brace bar 24 to bend and flex without breaking when used in a geosynthetic fabric layer to construct a stabilized earth wall and/or slope.

Figure 13:
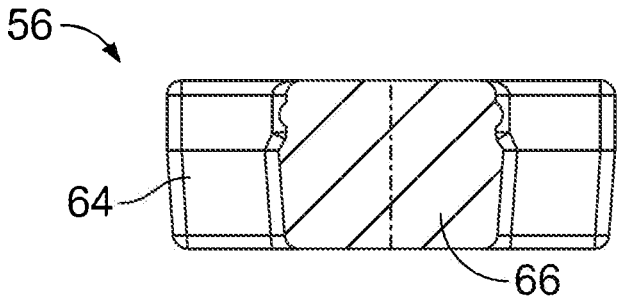
FIG. 13 is a cross-section of a connector of the bottom brace bar of FIG. 11 along the line D-D according to disclosed embodiments.
Figure 14:
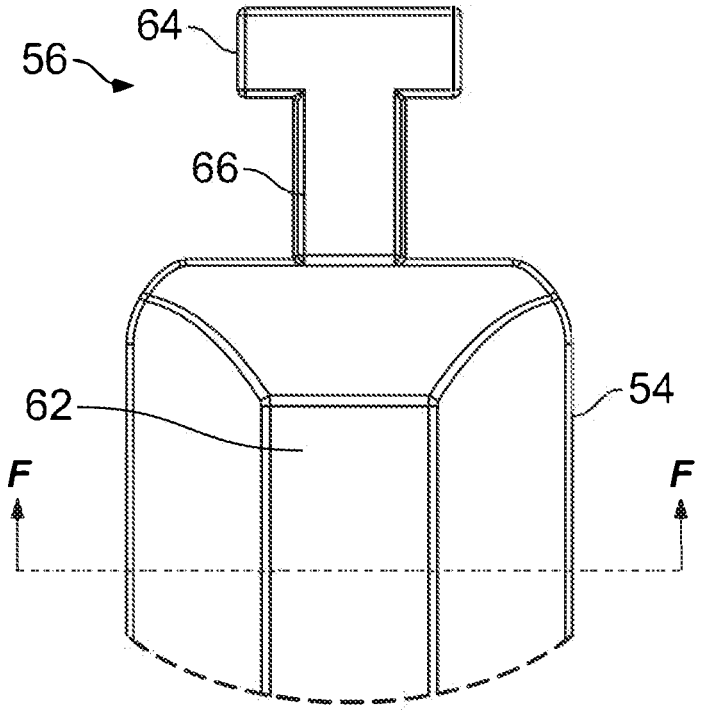
FIG. 14 is a front view of a section E of the bottom brace bar of FIG. 11 according to disclosed embodiments.

Furthermore, as seen in FIGS. 10-12, the first connector 56 of bottom brace bar 24 can be integrally formed or coupled to an end of the body 54. In some embodiments, the first connector 56 can be configured to interface with the first slot 36 of the standing brace bar 22 so as to couple the bottom brace bar 24 and the standing brace bar 22 together. Further still, in some embodiments, the first connector 56 can comprise a T-connector as descried herein. For example, FIG. 13 is a cross-section of the first connector 56 along the line D-D of FIG. 11, and FIG. 14 is a front view of a section E of the bottom brace bar 24 of FIG. 12 according to disclosed embodiments. As seen in FIGS. 13 and 14, the first connector 56 can include the T-connector having a head 64 and a neck 66.

Figure 15:
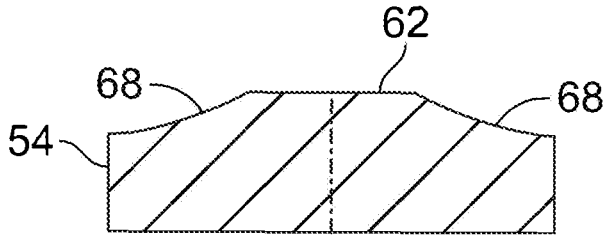
FIG. 15 is a cross-section of the bottom brace bar of FIG. 14 along the line F-F according to disclosed embodiments.

FIG. 15 is a cross-section of the bottom brace bar 24 along the line F-F shown in FIG. 14 according to disclosed embodiments. As seen in FIG. 15, the body 54, like the body 32, can include transition areas 68 that transition the height of the body 54 from the max height of the raised support section 62 to the max height of the remainder of the bottom brace bar 24. In some embodiments, the transition areas 68 can be curved or sloped in a concave manner to provide support strength to the bottom brace bar 24 so that the bottom brace bar 24 will not break under load when used in a geosynthetic fabric layer to construct a stabilized earth wall and/or slope.

Figure 16:
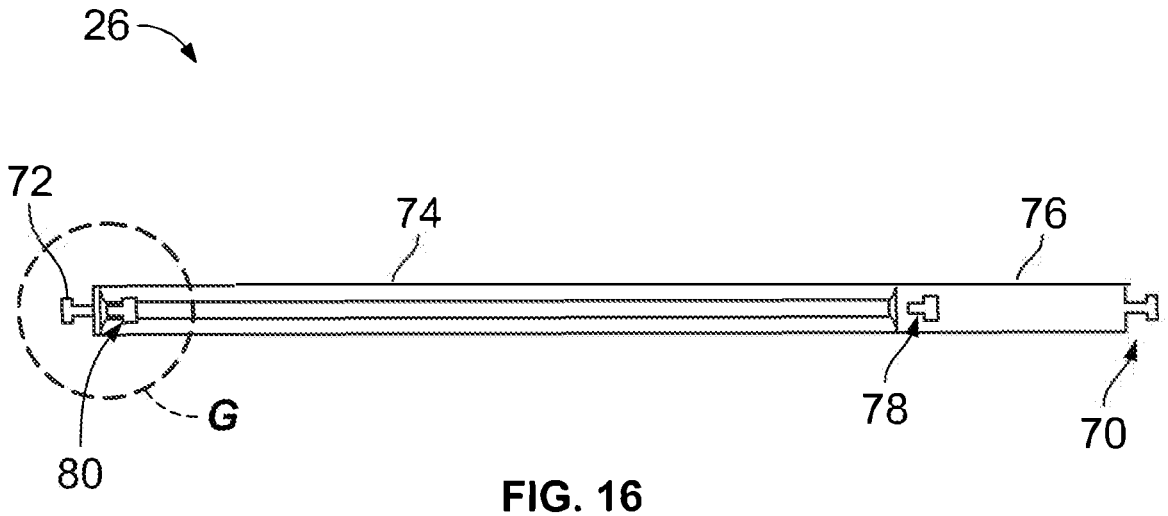
FIG. 16 is front view of a cross brace bar of the bracing assembly of FIG. 4 according to disclosed embodiments.

FIG. 16 is front view of the cross brace bar 26 according to disclosed embodiments. As seen in FIG. 16, the cross brace bar 26 can include a second connector 70 configured to interface with the second slot connection 42 in standing brace bar 22 to couple together the cross brace bar 26 and the standing brace bar 22. Additionally, the cross brace bar 26 can include a third connector 72 configured to interface with the third slot connection 58 in bottom brace bar 24 to couple together the cross brace bar 26 and the bottom brace bar 24. In some embodiments, the second connector 70 and the third connector 72 can be used interchangeably to couple the cross brace bar 26 to the standing brace bar 22 and the bottom brace bar 24 via the second and third slot connections 42 and 58. As seen in FIG. 16, in some embodiments, the cross brace bar 26 can include a fourth slot region 76 having a fourth slot connection 78 formed therein, and a body 74 having a fifth slot connection 80 formed therein. The fourth and fifth slot connections 78 and 80 can include T-slot connections as described herein and can be used to couple the cross brace bar 26 to the standing brace bar 22, the bottom brace bar 24, and/or other bracing bars in configurations different from the bracing assembly 20 as shown in FIG. 4. In some embodiments, the fourth and fifth slot connections 78 and 80 are omitted to simplify the cross brace bar 26 and to simplify construction of the bracing assembly 20.

Figure 17:
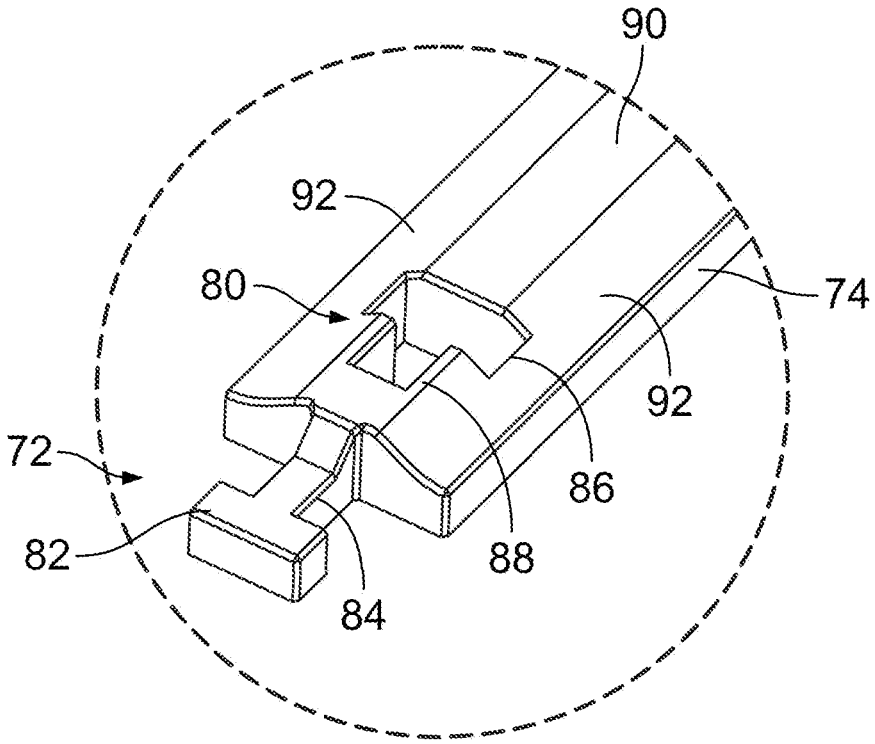
FIG. 17 is an isometric view of a section G of the cross brace bar of FIG. 16 according to disclosed embodiments.

FIG. 17 is an isometric view of a section G of the cross brace bar 26 according to disclosed embodiments. As seen in FIG. 17, the third connector 72 can comprise a T-connector having a head 82 and a neck 84. Though not shown in FIG. 17, the second connector 70 can likewise comprise T-connector having a head and neck. Furthermore, as seen in FIG. 17 the body 74, like the bodies 32 and 54, can include a raised support section 90 and transition areas 92 that transition the height of the body 74 from the max height of the raised support section 90 to the max height of the remainder of the cross brace bar 26. In some embodiments, the transition areas 92 can be curved or sloped in a concave manner to provide support strength to the cross brace bar 26 so that the cross brace bar 24 will not break under load when used in a geosynthetic fabric layer to construct a stabilized earth wall and/or slope.

Various embodiments for manufacturing the standing brace bar 22, the bottom brace bar 24, and the cross brace bar 26 are contemplated. Such embodiments include but are not limited to injection molding or the like. In some embodiments, the first slot region 30, the second slot region 34, the body 32, and the first guide tip 28 are formed as a single monolithic structure. Similarly, in some embodiments, the third slot region 52, the body 54, and the second guide tip 50 are formed as a single monolithic structure. Furthermore, the second connector 70, the third connector 72, and the body 74 can be formed as a single monolithic structure. Additionally, the bottom brace bar 24, the standing brace bar 22, and the cross brace bar 22 can be made of a non-metallic, rigid or semi-rigid material. In some embodiments, the non-metallic, rigid or semi-rigid material can include one of nylon, high-density polypropylene (HDPE), or another suitable polymer.

Figure 18:
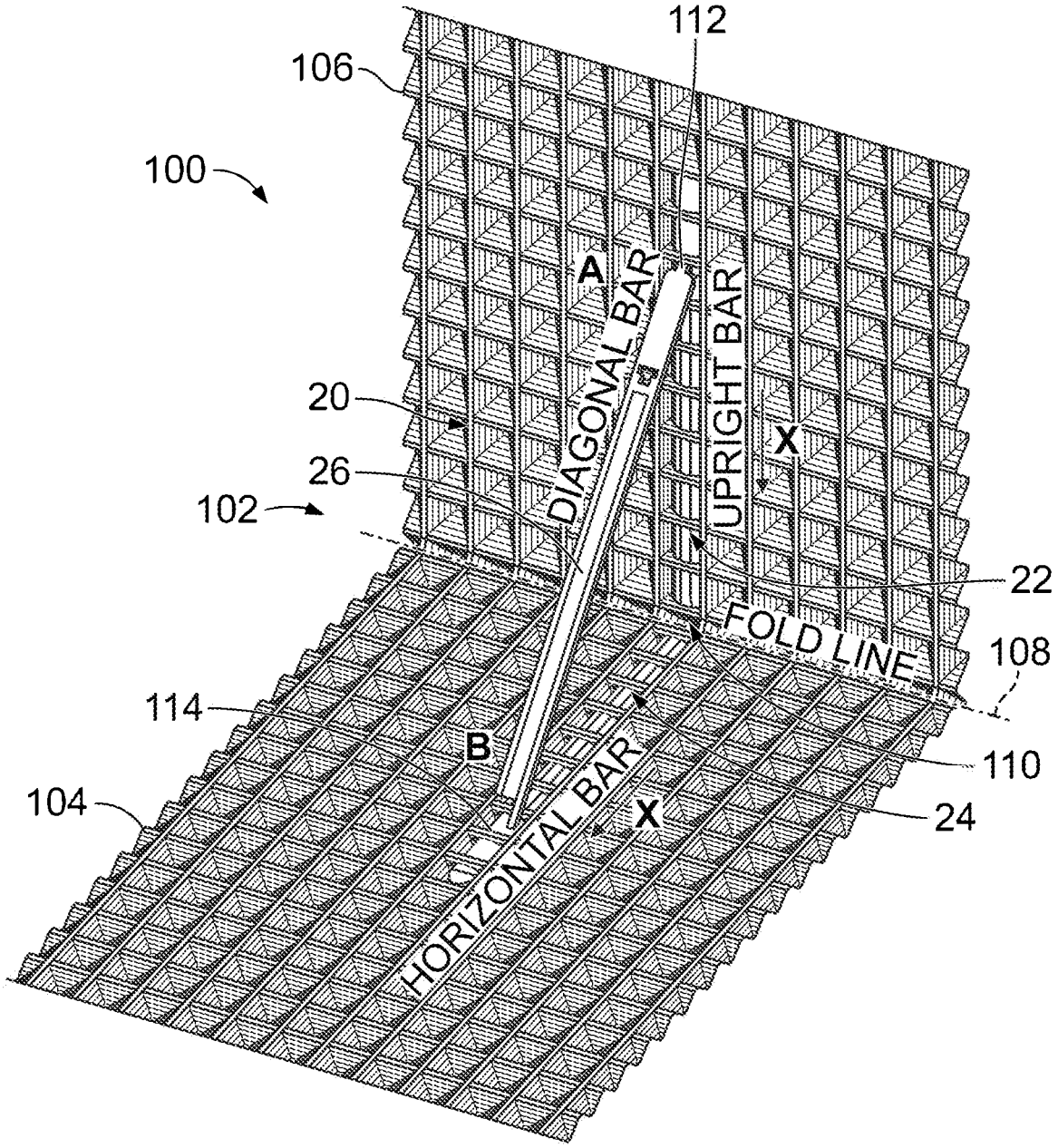
FIG. 18 is an isometric view of an internally braced geosynthetic fabric layer according to disclosed embodiments.

FIG. 18 is an isometric view of an internally braced geosynthetic fabric layer 100 according to disclosed embodiments. As seen in FIG. 18, the internally braced geosynthetic fabric layer 100 can employ the bracing assembly 20 and can include a three-dimensional woven geotextile fabric 102 having a horizontal layer section 104 and an external layer face 106. The external layer face 106 can be formed by an upright fold of the geotextile fabric layer 100 along a fold line 108 of the internally braced geosynthetic fabric layer 100. In some embodiments, the three-dimensional woven geotextile fabric 102 can be woven in a loom. Furthermore, the horizontal layer section 104 can be configured to receive soil backfill from a horizontal reinforcement layer portion of a reinforced earth zone and slope facing system. Further still, the external layer face 106 can be configured to provide a region of the reinforced earth zone and slope facing system against which soil backfill can be filled and compacted. In some embodiments the three-dimensional woven geotextile fabric 102 can include a three-dimensional pyramidal-woven geotextile fabric. However, additional non-pyramidal shapes for the three-dimensional woven geotextile fabric 102 are also contemplated.

To construct the geosynthetic fabric layer 100, the standing brace bar 22 and the bottom brace bar 24 can be inserted into a weave of the geotextile fabric 102 using the first guide tip 28 and the second guide tip 50 in a direction shown by the arrows X such that the bottom brace bar 24 is located in the horizontal layer section 104, the standing brace bar is located in the external layer face 106, and the first connector 56 is aligned with first slot connection 36 at the fold line 108. In some embodiments, the standing brace bar 22 and the bottom brace bar 24 can be inserted into the weave of the geotextile fabric 102 while the geotextile fabric 102 is in the loom. Additionally or alternatively, in some embodiments, the standing brace bar 22 and the bottom brace bar 24 can be inserted into the weave of the geotextile fabric 102 while the geotextile fabric 102 is in motion on the loom. Furthermore, in some embodiments, the standing brace bar 22 and the bottom brace bar 24 including the first and second guide tips 28 and 50 can be shaped slightly differently such that an installer can readily identify and differentiate the standing brace bar 22 from the bottom brace bar 24 so as to facilitate quick and reliable installation during the weaving process of the geotextile fabric 102. Such embodiments, greatly reduce the time and labor needed to install a system on a job site. For example, the preinstallation and differing configurations the standing brace bar 22 and the bottom brace bar 24 can reduce installation time by approximately 4 hours per every one roll of geosynthetic fabric layer 100.

Once the standing brace bar 22 and the bottom brace bar 24 are inserted into the weave of the geotextile fabric 102 and the geotextile fabric 102 has been fully woven, the geotextile fabric 102 can be folded along the fold line 108 so that the upright fold that forms external layer face 106 and the standing brace bar 22 are in an angled orientation relative to the horizontal layer section 104. Then, while the upright fold and the standing brace bar 22 are in the angled orientation, the bottom brace bar 24 can be coupled to the standing brace bar 22 to form a connection 110. In embodiments where the first slot connection 36 is the T-slot connection and the first connector 56 is the T-connector, the connection 110 can be formed by inserting the T-connector into upper portion 44 of a T-slot connection and sliding the T-connector down into the lower portion 46 of the T-slot connection to prevent the head 64 of the T-connector from passing through the upper portion 44 of the T-slot connection.

Furthermore, the geosynthetic fabric layer 100 can be constructed by coupling the cross brace bar 26 to the standing brace bar 26 to form connection 112 and coupling the cross brace bar 26 to the bottom brace bar 24 to form connection 114 as shown in FIG. 18. In embodiments where the second slot connection 42 and the third slot connection 58 comprise the I-slot connections, the connections 112 and 114 can be formed by inserting T-connector heads of the second and third connectors 70 and 72 through a the I-slot connections and then rotating the T-connector heads to prevent the heads from passing back through the I-slot connections.

In some embodiments, the woven geotextile fabric 102 with the inserted standing brace bar 22 and bottom brace bar 24 are joined together into a roll of similarly constructed woven geotextile fabric layers. Then, the roll can be spread out at a job site where the connections 110, 112, and 114 are formed in the manner described above. This procedure can eliminate some assembly of the system on the job site and allow the geotextile fabric 102 to arrive on site ready to be rolled out in place where the cross brace bar 26 can be added.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

What is claimed is:

1. A bracing assemblyfor a geosynthetic wrapped system, the bracing assembly comprising:

a standing brace bar having a first configuration of guide tips and slot connections that comprises a first guide tip, a first slot connection, and a second slot connection;

a bottom brace bar having a second configuration of guide tips, slot connections, and connectors different from the first configuration, the second configuration comprising a second guide tip, a third slot connection, and a first connector configured to interface with the first slot connection to couple the bottom brace bar to the standing brace bar; and a cross brace bar having a third configuration of connectors and slot connections different from the first and second configurations, the third configuration comprising a second connector configured to interface with the second slot connection to couple the cross brace bar to the standing brace bar and a third connector configured to interface with the third slot connection to couple the cross brace bar to the bottom brace bar, wherein the first guide tip and the second guide tip are sized and shaped to direct insertion of the standing brace bar and the bottom brace bar respectively into a weave of a geotextile fabric material such that the first connector and the first slot connection are aligned together and with a fold line of the geotextile fabric material.

2. The bracing assembly of claim 1 wherein the standing brace bar comprises a first slot region in which the first slot connection is formed, a second slot region in which the second slot connection is formed, and a body disposed between the first slot region and the second slot region, wherein the first slot region is disposed between the first guide tip and the body.

3. The bracing assembly of claim 2 wherein the first slot region, the second slot region, the body, and the first guide tip are formed as a single monolithic structure.

4. The bracing assembly of claim 2 wherein a respective maximum height of the first slot region and the second slot region is less than a respective maximum height of the body.

5. The bracing assembly of claim 1 wherein the bottom brace bar comprises a slot region in which the third slot connection is formed and a body disposed between the slot region and the first connecter, wherein the slot region is disposed between the second guide tip and the body.

6. The bracing assembly of claim 5 wherein the slot region, the body, and the second guide tip are formed as a single monolithic structure.

7. The bracing assembly of claim 5 wherein a respective maximum height of the slot region is less than a respective maximum height of the body.

8. The bracing assembly of claim 1 wherein the first connector comprises a first T-connector, the second connector comprises a second T-connector, and the third connector comprises a third T-connecter, wherein the first slot connection comprises a T-slot connection configured to receive the first T-connector through an upper portion of the T-slot and secure the first T-connector with a lower portion of the T-slot so as to couple the bottom brace bar to the standing brace bar, and wherein the second slot connection and the third slot connection comprise respective I-connectors configured to receive the second and third T-connectors, wherein the second and third T-connectors are rotated so as to couple the cross brace bar to the bottom brace bar.

9. The bracing assembly of claim 1 wherein the first guide tip and the second guide tip comprise respective bullnose shapes.

10. The bracing assembly of claim 1 wherein the bottom brace bar, the standing brace bar, and the cross brace bar are made of non-metallic, rigid or semi-rigid material.

11. The bracing assembly of claim 10 wherein the non-metallic, rigid or semi-rigid material includes one of nylon and high-density polypropylene (HDPE).

12. An internally braced geosynthetic fabric layer comprising:

a three-dimensional woven geotextile fabric having a horizontal layer section and an external layer face, the external layer face formed by an upright fold of the geotextile fabric; and a bracing assembly that supports the external layer face in an upright position, the bracing assembly comprising:

a standing brace bar inserted into a weave of the upright fold of the geotextile fabric and having a first configuration of guide tips and slot connections;

a bottom brace bar inserted into a weave of the horizontal layer section of the geotextile fabric, coupled to the standing brace bar proximate to a fold line of the geotextile fabric, and having a second configuration of guide tips, slot connections, and connectors different from the first configuration; and a cross brace bar coupled to the standing brace bar and the bottom brace bar and having a third configuration of connectors and slot connections different from the first and second configurations, wherein the horizontal layer section is configured to receive soil backfill to form a horizontal reinforcement layer portion of a reinforced earth zone and slope facing system, and wherein the external layer face is configured to provide a region of the reinforced earth zone and slope facing system against which soil backfill is filled and compacted.

13. The internally braced geosynthetic fabric layer of claim 12 wherein the first configuration comprises a first guide tip, a first slot connection, and a second slot connection, wherein the second configuration comprises a second guide tip, a third slot connection, and a first connector that interfaces with the first slot connection to couple the bottom brace bar to the standing brace bar, wherein the third configuration comprises a second connector that interfaces with the second slot connection to couple the cross brace bar to the standing brace bar and a third connector that interfaces with the third slot connection to couple the cross brace bar to the bottom brace bar, and wherein the first guide tip and the second guide tip are sized and shaped to direct insertion of the standing brace bar and the bottom brace bar respectively into the weave of the geotextile fabric such that the first connector and the first slot connection are aligned together and with the fold line of the geotextile fabric.

14. The internally braced geosynthetic fabric layer of claim 13 wherein the first connector comprises a first T-connector, the second connector comprises a second T-connector, and the third connector comprises a third T-connecter, wherein the first slot connection comprises a T-slot connection configured to receive the first T-connector through an upper portion of the T-slot and secure the first T-connector with a lower portion of the T-slot so as to couple the bottom brace bar to the standing brace bar, and wherein the second slot connection and the third slot connection comprises respective I-connectors configured to receive the second and third T-connectors, wherein the second and third T-connectors are rotated so as to couple the cross brace bar to the bottom brace bar.

15. The internally braced geosynthetic fabric layer of claim 12 wherein the first guide tip and the second guide tip comprise respective bullnose shapes, and wherein the three-dimensional woven geotextile fabric includes a three-dimensional pyramidal-woven geotextile fabric.

16. The internally braced geosynthetic fabric layer of claim 12 wherein the bottom brace bar, the standing brace bar, and the cross brace bar are made of non-metallic, rigid or semi-rigid material.

* * * * *